United States Patent [19]

Miura

[11] 4,239,199

[45] Dec. 16, 1980

[54] CLAMPING APPARATUS FOR A GUILLOTINE TYPE CUTTER

[76] Inventor: Isamu Miura, 6/16,3, Ryusen, Taito-ku, Tokyo, Japan

[21] Appl. No.: 941,717

[22] Filed: Sep. 12, 1978

[30] Foreign Application Priority Data

Sep. 16, 1977 [JP] Japan ..... 52/110532
May 29, 1978 [JP] Japan ..... 53/63349

[51] Int. Cl.[3] ..... B25B 1/24
[52] U.S. Cl. ..... 269/266
[58] Field of Search ..... 83/642, 643, 388, 389, 83/390, 460, 461, 613; 269/266, 224, 254 CS, 265

[56] References Cited

U.S. PATENT DOCUMENTS

| | | | |
|---|---|---|---|
| 1,499,989 | 7/1924 | Lehmann | 269/266 |
| 2,520,495 | 8/1950 | Dehn | 83/389 |
| 2,790,361 | 4/1957 | Swanson et al. | 269/254 CS |
| 3,868,102 | 2/1975 | Perar | 269/266 |

*Primary Examiner*—Robert C. Watson
*Attorney, Agent, or Firm*—Sughrue, Rothwell, Mion, Zinn and Macpeak

[57] ABSTRACT

This is an invention concerning an improvement of the clamp equipped in the cutting machine (guillotine) for cutting a pile of paper or similar materials.

This invention consists in construction of the clamp in which the presser foot having clamping surfaces to press the cutting material and gauge surfaces facing the knife is composed of an alignment of many partial presser feet, each of which can individually be displaced according to the reaction force generated in pressing the cutting material. Even in case there is uneven thickness of cutting material or partial variation in compressibility, uniform clamping is obtained and brings about the good effect that the guillotine cutting is smoothly and exactly achieved.

3 Claims, 6 Drawing Figures

CLAMPING APPARATUS FOR A GUILLOTINE TYPE CUTTER

FIELD OF THE INVENTION

This is an invention concering an improvement of the clamp in a guillotine type cutter for cutting a pile of paper and similar materials.

BACKGROUND OF THE INVENTION

The clamp of conventional guillotines are constructed in one piece to move up and down as a whole, close to the knife, so that the sole surface or the clamping surface presses, in a straight line, the cutting material such as paper or the likes on the table surface of the guillotine.

If cutting material which is so uniform in thickness as a simple pile of paper, this type of clamp does not cause much trouble in cutting, as the cutting material is clamped with uniform pressure. However, if the cutting material is, for example, a pile of printed paper or bound books which are glued on the back or the like, in the former case where there is so uneven thickness as the printed parts with ink are thicker than other nonprinted parts, and, in the latter case where the glued back parts are thicker than other parts and also there is much variation in compressibility or compressive modulus, although the cutting material may be pressed in a straight line, the other parts mentioned above cannot uniformly be pressed. Consequently, in case of cutting, the cut surface is warped, or in the cut part which is not sufficiently clamped, there is slippage of paper at the cut, or worst of all, the knife blade of the guillotine is broken.

In order to prevent such an accident, a pad is usually attached to the clamping surface of the clamp to compensate for uneven thickness of cutting material. However, it is quite difficult to make a pad which can completely prevent the above-mentioned accident from ocurring, for even the same cutting materials must be more or less different in shape. Besides, in case of providing a pad, the position of cutting material to be placed should be exactly fixed, therefore, reduction of operating efficiency is inevitable. And, on the contrary, it may require much trouble to locate the pad properly on the cutting material for every cut, or, worse, it may be dangerous and is not possibly practicable.

OBJECT OF THE INVENTION

This invention has the object of solving the above-mentioned problem in the conventional guillotine equipped with one-piece clamp which provides pressing along a straight line. Namely, the first object of the invention is to furnish a clamp which can press the cutting material uniformly, even if the cutting material is partially uneven in thickness, compressibility or compressive modulus, and thus, in case of cutting, there is no distortion in the cutting surface and no slip-out of the cut paper cut. Therefore, this invention attains the above-mentioned purpose in that the presser foot part of the clamp which is built in one piece and having a gauge surface moving along and close to the knife and the clamping surface pressing the cutting material, is composed of an alignment of many partial presser feet and also the individual partial presser feet may be displaced independently by the reaction force generated in case of pressing the cutting material.

Besides, the second object of the invention is met as below:

If part of the surfaces of partial presser feet clamps the marginal edge of the cutting material, extremely large pressure may be applied to the marginal edge, which may be warped or damaged. In this case, without using a troublesome method to adjust the clamping pressure of partial presser foot, this invention simply prevents such extremely large pressure from being applied. Therefore, in the invention, the above-mentioned partial presser feet are connected with a connecting piece so that adjoing partial presser feet may be connected to each other and provide displacement as one piece. In other words, by connecting a partial presser foot whose clamping surface is placed on the marginal edge of cutting material to the adjoing partial presser foot the whole clamping surface presses the cutting material through a connecting piece, and the pressure applied to the marginal edge as mentioned above is prevented from being over two times as high as the pressure applied to the cutting machine under the whole clamping surface of the presser foot.

The invention is explained by the attached drawings as below:

BRIEF DESCRIPTION OF THE DRAWINGS

FIGS. from 2 to 4 show Front View, Plan and a cross-section through lines A-A of one example of the clamp as referred to in the invention.

DESCRIPTION OF THE PREFERRED EMBODIMENT

Figure 1:
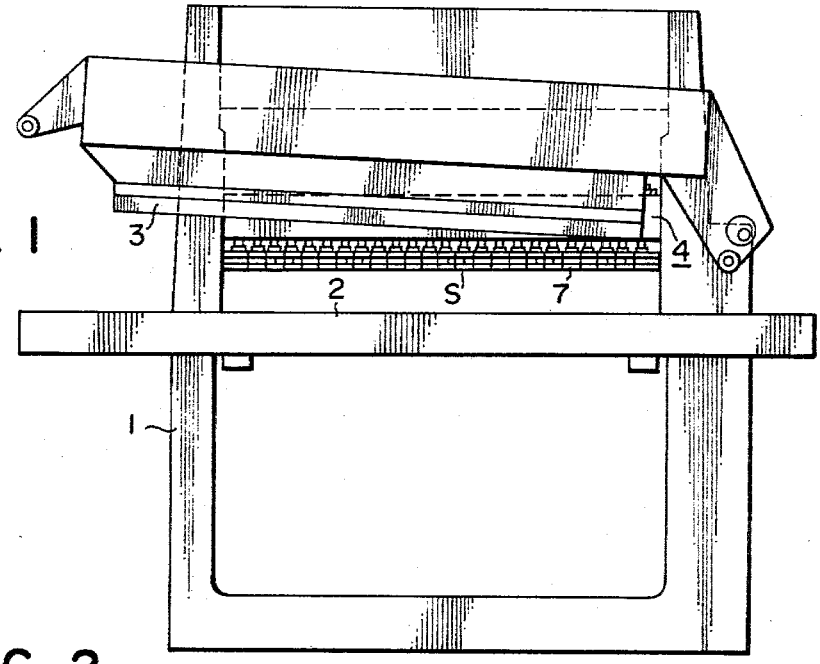
FIG. 1 shows Front View of the guillotine equipped with the clamp as referred to in the invention.
Figure 5:
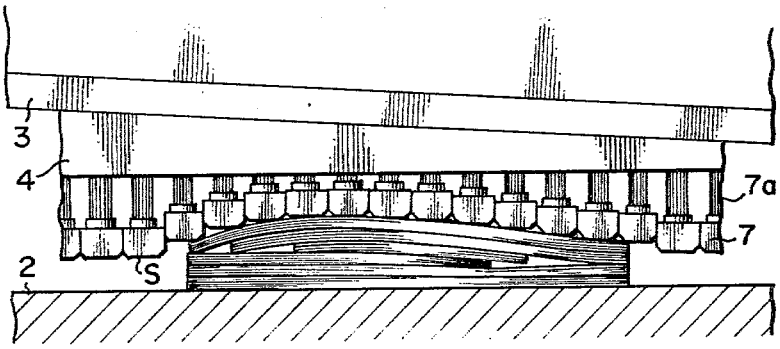
FIG. 5 is a Partial Front View showing the condition where uneven thickness of cutting material is pressed with the clamp as referred to in the invention.
Figure 6:
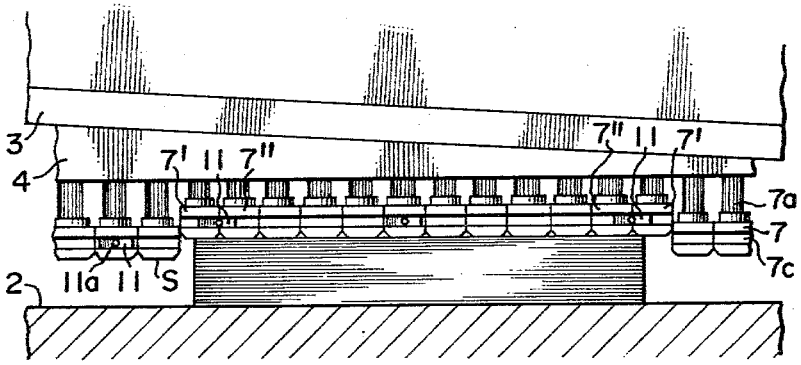
FIG. 6 is a Partial Front View of the guillotine showing the using condition of the clamp as referred to in the invention to prevent extremely large pressure from being applied to the mardignal edge of cutting material.

In FIGS. 1, 5 and 6, elements commonly shown bear identical numerals. In that respect, the invention is directed to a guillotine type of cutting apparatus, referred to throughout as the guillotine, the guillotine including a frame 1 which supports a table 2 and which carries a knife which falls from an upwardly inclined position or condition to a horizontal position or condition by means of a link arrangement which is of well known construction (not shown).

The guillotine further comprises a clamp which moves up and down as a whole by means of the link mechanism and the clamping surface is composed of adjacent, split therefore partial clamping surfaces which are in alignment. A frame 5 for the clamp is drilled and equipped with many cylinders which are arranged in alignment.

Figure 4:
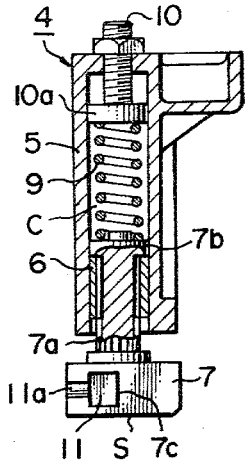

In FIG. 4, a spline sleeve 6 is fitted to and set within the cylinder and slides relative to a spline shaft 7*a* of the presser foot 7 which defines a partial or split clamping surface S. In addition, the front and rear of the presser foot 7 are aligned to form a gauge surface. Pins 8 carried by frame 5 fix the spline sleeves. Spring washers 7*b* are provided to the spline shaft 7*a* and may be bolt tightened. A coil spring 9 is interposed between the spline shaft spring washer 7*b* and an upper spring washer 10*a* within cylinder 5 and rotates freely with respect to a spring pressure adjusting screw 10 carried by cylinder 5 on the opposite side of the spring washer 10*a* from the spring 9.

On the guillotine as indicated in FIG. 1, as the cutting material is pressed by the clamp which is built up as mentioned above and cut, although the cutting material may be uneven in thickness as shown in FIG. 5, it can be evenly clamped with nearly uniform pressure to obtain smooth and exact cutting with no distortion of cutting surface or slide-out of paper cut, or no damage of knife blade.

In case of extremely uneven thickness of cutting material or a bound book as indicated in FIG. 5, if the thick parts or the back part is clamped with the split clamping surface and cut after adjustment has been made in advance to weaken the bounding force of the split clamping surface applied to the thicker parts or the back of book, exact cut can be obtained and there is no problem even in cutting difficult paper.

Besides, the clamp as referred to in the invention which is shown in FIGS. 4 to 6 is provided with a groove 7*c* with which mutually adjoing aligned presser feet 7 are connected to each other at, at least one side of the front or rear of the presser feet, and a sliding connecting piece 11 is fit and set inside the groove 7*c*. The length of the connecting piece 11 is slightly shorter than the width of the presser feet 7 and by pushing a pin 11*a* to the right or left side, the connecting piece 11 can be moved to any position inside the groove 7*c*.

Figure 2:
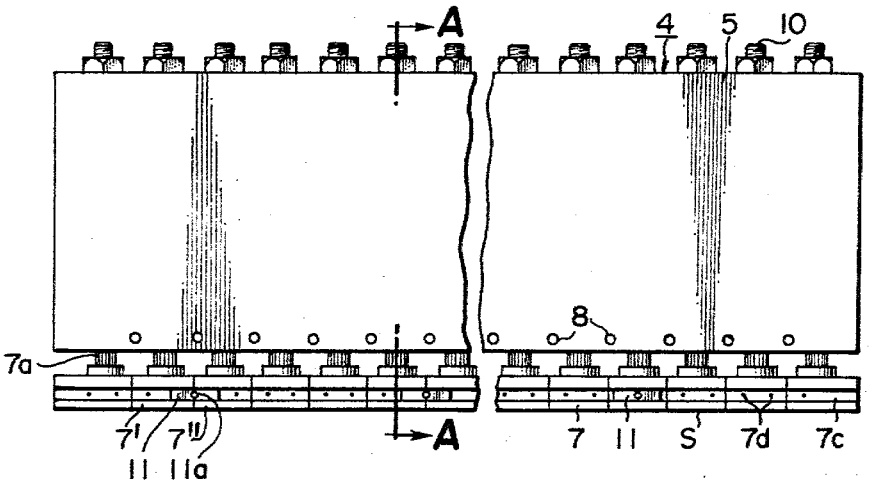
Figure 3:
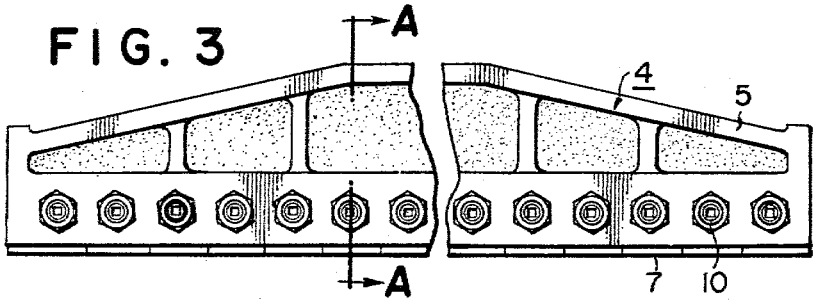

And, in case a connecting piece is placed on the left side position across between two presser feet 7' and 7 as shown in FIG. 2, then these two presser feet 7' and 7 can make displacement as one piece, while, in case of the connecting piece as shown on the right side inside one presser foot 7, it makes no difference as if no connecting piece 11 were used.

Accordingly, as shown in FIG. 6, when part of split clamping surface of the presser foot 7' is placed on a marginal edge and the cutting material is placed under the presser feet 7'', if the presser feet 7' and 7'' are connected with a connecting piece 11 as indicated in the Figure, as the pressing force is to be applied at least to the area of the clamping surface of the presser foot 7'', the pressure applied to the marginal edge of cutting material will not be over two times the clamping pressure applied to the cutting material on the whole surface of partial presser foot, therefore, there is no distortion or danger occurs at the marginal edge of cutting material.

If the presser foot 7'' is further connected with other connecting piece 11, it is a matter of course tht the pressure applied to the marginal edge will not be over 1.5 times. However, multi-connection like this may reduce the features of the clamp which the partial presser foot gives pressing.

Besides, as shown in FIG. 2 a hollow 7*d* for a click stop is provided inside the groove 7*c* for setting a connecting piece 11 across between two presser feet. Although the connecting piece 11 is not shown in the Figure, a leaf spring is provided with a protrusion for connecting the hollow 7*d* so that the position of connecting piece may not be shifted.

In case the presser feet are arranged in two rows, at the front and rear, to make the clamp as referred to in the invention fit variation in thickness in forward or backward direction, it is preferable to provide grooves connecting each of the presser feets in the front and rear rows and set the connecting piece.

As mentioned above, with the clamp for the invention, excellent cutting results can be achieved as below:

The cutting material can be pressed with approximately uniform pressure, even if it has uneven thickness, therefore, in cutting, there is no distortion of cutting surface or no slipout of paper cut, or no damage of the cutter blade occurs, and besides, in case part of the clamping surface of the presser foot is placed on the marginal edge of cutting material, pressure applied to the clamping surface can be very simply adjusted and controlled below the limit not to distort or damage the marginal edge parts.

The invention is applicable not only to the examples as indicated in the Figures but also to other cases that the displacement of the split clamping surface of the clamp is provided against hydraulic pressure and where a thimble joint type of connecting piece is used instead of the slide type for connecting two adjoing presser feet. Besides, as a matter of course the whole clamp may move down by means of hydraulic pressure.

I claim:

1. A clamp for a guillotine having a cutting blade movable vertically upwardly from and downwardly towards a table supporting material to be severed, said clamp being positioned adjacent said guillotine blade and extending along said blade for contact with the material to be cut and for pressing the material against the table during cutting operation, the improvement wherein said clamp comprises:

a plurality of adjacent, aligned partial presser feet defining individual clamping surfaces for pressing the cutting material, means for independently displacing the partial presser feet in a direction away from said table in accordance to the reaction force generated during pressing of the cutting material against the table, and said clamp further comprising a connecting piece for connecting any pair of adjoining partial presser feet to cause said adjacent, adjoining partial presser feet to be displaceable as a unit.

2. The clamp as claimed in claim 1, wherein said partial presser feet are provided with a groove along the longitudinal sides of said adjacently positioned partial presser feet, said grooves receiving said connecting piece for sliding within said grooves to connect adjoining partial presser feet dependent upon the longitudinal position of said connecting piece with respect to said plurality of partial presser feet.

3. The clamp as claimed in claim 1, wherein an adjustably biased coil spring presses axially downward against each partial presser feet such that the partial presser feet are displaceable against the pressure of the adjustable coil spring in accordance to the reaction force generated when pressing the cutting material against the table.

* * * * *